US011235592B2

(12) United States Patent
Niedermeier

(10) Patent No.: US 11,235,592 B2
(45) Date of Patent: Feb. 1, 2022

(54) DIRECT PRINTING DEVICE FOR APPLYING A CIRCUMFERENTIAL PRINT

(71) Applicant: KRONES AG, Neutraubling (DE)

(72) Inventor: Anton Niedermeier, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 16/644,471

(22) PCT Filed: Jul. 25, 2018

(86) PCT No.: PCT/EP2018/070095
§ 371 (c)(1),
(2) Date: Mar. 4, 2020

(87) PCT Pub. No.: WO2019/042663
PCT Pub. Date: Mar. 7, 2019

(65) Prior Publication Data

US 2021/0060974 A1 Mar. 4, 2021

(30) Foreign Application Priority Data

Sep. 4, 2017 (DE) ..... 10 2017 215 481.0

(51) Int. Cl.
*B41J 3/407* (2006.01)
*B41M 1/40* (2006.01)

(52) U.S. Cl.
CPC ..... *B41J 3/4073* (2013.01); *B41J 3/407* (2013.01); *B41J 3/40733* (2020.08); *B41M 1/40* (2013.01)

(58) Field of Classification Search
CPC ..... B41J 3/4073; B41J 3/407; B41J 3/40733; B41M 1/40
See application file for complete search history.

(56) References Cited

U.S. PATENT DOCUMENTS

2009/0251523 A1* 10/2009 Noll ..... B41J 3/4073 347/106
2011/0073512 A1 3/2011 Herrmann
(Continued)

FOREIGN PATENT DOCUMENTS

CN 103891688 A 7/2014
DE 19927668 A1 12/2000
(Continued)

OTHER PUBLICATIONS

China National Intellectual Property Administration, Office Action and Search Report Issued in Application No. 201880057173.3, dated Sep. 16, 2020, 15 pages.
(Continued)

*Primary Examiner* — Henok D Legesse
(74) *Attorney, Agent, or Firm* — McCoy Russell LLP

(57) ABSTRACT

The invention relates to a direct printing device for applying a circumferential print onto containers with at least one container seam, comprising a printhead which is configured to print directly onto a container, a detection device which is adapted such that at least one predetermined feature of the container is detected, a computing device which is configured to determine whether and possibly how the container is to be oriented in order to be moved from an actual container orientation to a predetermined target container orientation, and an orientation device which is configured to orient the container to the target container orientation on the basis of the determination by the computing device. The target container orientation is predetermined such that the container seam is oriented relative to the printhead such that a print seam, which is produced during the application of a circumferential print, substantially coincides with the container seam.

17 Claims, 2 Drawing Sheets

(56) References Cited

U.S. PATENT DOCUMENTS

| | | | | |
|---|---|---|---|---|
| 2014/0374016 | A1 | 12/2014 | Schach | |
| 2015/0138295 | A1* | 5/2015 | Lindner | B41M 1/40 347/110 |
| 2018/0001624 | A1* | 1/2018 | Koers | B41J 3/40733 |

FOREIGN PATENT DOCUMENTS

| | | | |
|---|---|---|---|
| DE | 102007025524 | A1 | 12/2008 |
| DE | 202011108761 | U1 | 3/2012 |
| DE | 102015100334 | A1 | 7/2016 |
| DE | 102015216026 | A1 | 2/2017 |
| DE | 102015225957 | A1 | 6/2017 |

OTHER PUBLICATIONS

ISA European Patent Office, International Search Report Issued in Application No. PCT/EP2018/070095, Oct. 26, 2018, WIPO, 2 pages.

* cited by examiner (State of the art)

DIRECT PRINTING DEVICE FOR APPLYING A CIRCUMFERENTIAL PRINT

CROSS-REFERENCE TO RELATED APPLICATIONS

The present application is a U.S. National Phase of International Patent Application Serial No. PCT/EP2018/070095 entitled "DIRECT PRINTING DEVICE FOR APPLYING A CIRCUMFERENTIAL PRINTED IMAGE," filed on Jul. 25, 2018. International Patent Application Serial No. PCT/EP2018/070095 claims priority to German Patent Application No. 10 2017 215 481.0 filed on Sep. 4, 2017. The entire contents of each of the above-referenced applications are hereby incorporated by reference for all purposes.

TECHNICAL FIELD

The invention relates to a direct printing device for applying a circumferential print onto containers with at least one container seam.

BACKGROUND AND SUMMARY

Many containers, in particular bottles, have container seams for reasons of production. Often these are press seams, where a container then typically has two oppositely disposed container seams running in the longitudinal direction. Container seams are particularly pronounced in glass containers, but plastic containers still have visible container seams as well. Container seams typically run along the longitudinal axis of the containers and extend over the entire length of the container.

If a print is to be applied onto containers by way of direct printing, the print will always be depicted with reduced quality in the region of the container seams. However, with a circumferential print, i.e. a print that is applied all the way around the container, it is not possible to avoid that the print runs over the container seams. This inevitably results in imperfections in the appearance of the print.

The circumferential print entails a further problem, namely that, even with highly optimized printing processes, there is always a visible seam, overlap, or connection point where the circumferential print begins and ends. Therefore, the appearance of the print is also reduced there. FIG. 1*a* schematically shows such an impaired appearance of the print.

The invention is based on the problem of providing a direct printing device and a direct printing method for applying a circumferential print onto containers with container seams which allow for improved appearance of the print with fewer imperfections.

This problem is solved by the subject matter of the independent claims.

The direct printing device for applying a circumferential print onto containers comprises a printhead, in particular a printhead operating according to the drop-on-demand principle, which is configured to print directly onto a container, a detection device which is adapted such that at least one predetermined feature of the container is recorded, for example a marking, a relief, an embossing, the container seam or any other feature that is in a defined angular relationship to the container seam, a computing device which is configured to determine based on the at least one feature whether and, if so, how the container is to be oriented in order to be moved from an actual container orientation to a predetermined target container orientation, and an orientation device which is configured to orient the container to the target container orientation on the basis of the determination by the computing device. The target container orientation is predetermined such that the container seam is oriented relative to the printhead such that a print seam which is produced during the application of a circumferential print substantially coincides with the container seam.

A device adapted in such a manner allows for the unavoidable print seam to optically not represent an additional point of imperfection. Since the print seam is very narrow anyway and coincides with the container seam, the print seam itself is not noticeable. This improves the appearance of the print by reducing the number of visible seams.

A circumferential print refers in particular to a print that runs around the entire circumference of the container or, in other words, by 360° (possibly with slight deviations, for example, due to inaccuracies when printing).

The at least one feature can comprise, for example, at least one, in particular exactly one or exactly two markings. Alternatively or in addition, the at least one feature can comprise a container seam, in particular exactly one or exactly two container seams.

The use of features of the container is advantageous because it can be comparatively elaborate in terms of computing to detect the entire container and calculate the orientation therefrom. In most cases, one feature or very few features are already sufficient to reflect the container orientation very precisely and the computational effort is greatly reduced. In addition, it is conceivable that a container has two container seams. Then it can perhaps not be possible to unambiguously determine the container orientation without using other features (for example for symmetry reasons, e.g. if the container seams are exactly opposite each other). Such unique determination is possibly also not necessary at all, because it is crucial that one of the container seams is at the suitable position for direct printing.

The orientation device can be adapted such that, after orientation of the container, the container seam is arranged at the location where the circumferential print begins and/or ends during operation. Where the print begins or ends arises, for example, from the geometry of the transport path, the arrangement of the printhead or printheads, and optionally other parameters of the printing device. The respective location can be calculated, for example, for the respective parameters and/or be empirically determined and then stored in a storage device.

The location where the print begins (and also ends since it is a circumferential print) is the one where the print seam is created. Therefore, such an orientation ensures particularly reliably that the print seam substantially coincides with the container seam.

The computing device can be adapted such that it determines the actual position of the at least one feature and that, based on the actual position of the at least one feature and a predetermined target position of the at least one feature, it determines whether and, if so, how the container is to be oriented.

As already explained, the use of a feature is particularly suitable for detecting the container orientation. If an actual and a target position of the feature are used to determine whether and, if so, how the container is to be oriented, it is not necessary to perform an actual spatial determination of the container orientation (and associated therewith, possible recognition of the container geometry), which may be complex and computationally intensive. A comparatively simple comparison of individual features is instead sufficient. As an example, it can suffice that a marking on the container or a container seam, which can be detected comparatively easily, is detected and that it is then determined at which position they are actually to be located. For example, a difference value can be formed from this. It can then either be calculated based on this value how the container must be oriented. Some other form of determining how the container is to be oriented is also possible. For example, corresponding instructions or values for the respective difference values can already be stored on a storage device and describe how the container is to be oriented if a certain difference value is given. For example, a set of parameters can be stored for a specific difference value and set the orientation device to orient the containers.

The computing device can be adapted such that it determines the actual position of the at least one feature and that it determines the actual container orientation based on the actual position of the at least one feature and that it determines, based on the actual container orientation and the target container orientation, whether and, if so, how the container is to be oriented.

It is conceivable, for example, that the orientation device requires the container orientation as input values and that a difference value as described above does not suffice. Alternatively, it is conceivable that the container orientation is needed anyway for other process steps, so that it is suggested to determine it also for determining whether and how the container is to be oriented.

The detection device can be adapted such that the at least one feature is detected optically, and the computing device can be adapted such that an or the actual position of the at least one feature is determined by means of image recognition. It is then possible to use visible light for optical detection. Alternatively, however, it is also conceivable to use optical detection in other wavelength ranges.

Optical detection is advantageous for the reason that optical features can be applied particularly easily or for the reason that the container seams are already optically recognizable and for the reason that optical measuring methods, for example with a camera, are advantageous and uncomplicated. It can even be possible to respectively adapt existing systems, for example, for optical quality control.

The detection device can comprise a camera which images at least one partial region of the container, where the at least one partial region is selected in such a way as to ensure that the at least one feature is located in the at least one partial region, regardless of the actual container orientation.

Cameras are cheap and comparatively small and simple components that nevertheless provide very accurate results. It is conceivable to image only a partial region of the container, i.e. not the entire container. For example, it is conceivable that the container has at least two features, for example, both the container seam as well as a marking and/or two container seams and/or two markings, which are arranged such that it is sufficient to image only a partial region of the container, for example opposite each other. For example, panning the camera or providing multiple cameras or orienting the container in several steps can be dispensed with, since there is always at least one feature in the field of view.

The orientation device can be configured to rotate the containers about their own axis. In particular, when the containers are transported in a guided manner, it can already suffice to only rotate them for suitable orientation.

The orientation device can be adapted such that an angle by which the containers are rotated during the orientation depends at least on the actual container orientation and the predetermined target container orientation. A transport path of the containers remaining between the orientation device and the printhead can possibly also be taken into account, especially if it does not run in a straight line but, for example, on a circular trajectory.

The invention also provides a direct printing method.

With the direct printing method for applying a circumferential print onto containers with at least one container seam, at least one predetermined feature of the container, for example, a marking or the container seam, is recorded by way of a detection device, it is determined by way of a computing device based on the at least one feature whether and, if so, how the container is to be oriented in order to be moved from an actual container orientation to a predetermined target container orientation, the container is oriented to the target container orientation based on the determination by the computing device, and the container is printed on by way of a printhead after the container has been oriented. The target container orientation is predetermined such that the container seam is oriented relative to the printhead such that a print seam, which is produced during the application of a circumferential print, substantially coincides with the container seam.

The orientation of the container can be effected in such a way that the container seam is arranged, after the container has been oriented, at the location where the circumferential print begins and/or ends.

The direct printing method can comprise that the actual position of the at least one feature is determined and that, based on the actual position of the at least one feature and a predetermined target position of the at least one feature, it is determined whether and, if so, how the container is to be oriented.

The direct printing method can comprise that the actual position of the at least one feature is determined and the actual container orientation is determined based on the actual position of the at least one feature and that it is determined based on the actual container orientation and the target container orientation whether and, if so, how the container is to be oriented.

The direct printing method can comprise that the at least one feature is detected optically, in particular by way of at least one camera, and a or the actual position of the at least one feature is determined by means of image recognition.

The direct printing method can comprise that at least one partial region of the container is imaged, where the at least one partial region is selected in such a way as to ensure that the at least one feature is located in the at least one partial region, regardless of the actual container orientation.

The direct printing method can comprise that the container is rotated about its own axis for orienting the container, in particular about an angle that depends at least on the actual container orientation and the predetermined target container orientation.

It is understood that the features and advantages mentioned in the context of the device are also applicable to the method.

BRIEF DESCRIPTION OF THE FIGURES

Further features and advantages shall be explained below using the exemplary figures, where.

DETAILED DESCRIPTION

Figure 1A:
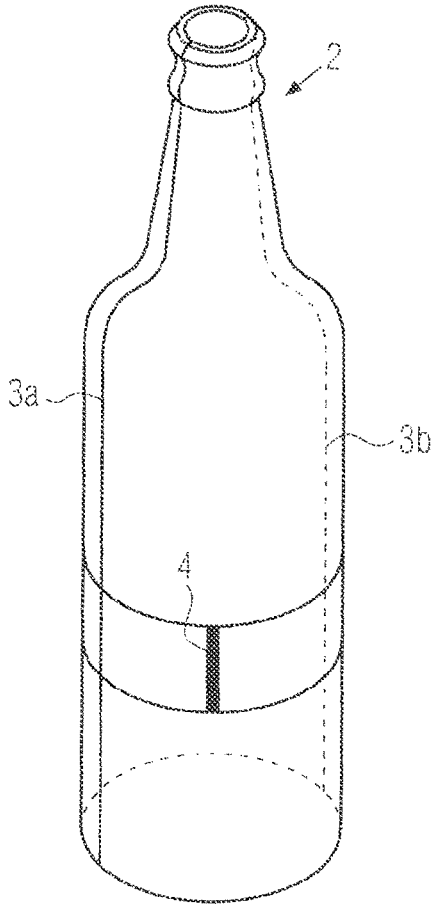
FIGS. 1*a* and 1*b* are schematic representations of a circumferential print obtained with a direct printing device known from prior art and a circumferential print obtained with a direct printing device according to the invention.

As already mentioned above, FIG. 1*a* shows schematically a print as it is obtained with a printing device known from prior art. A container 2 with two container seams 3*a* and 3*b* is shown there. In addition, print seam 4 is shown.

Figure 1B:
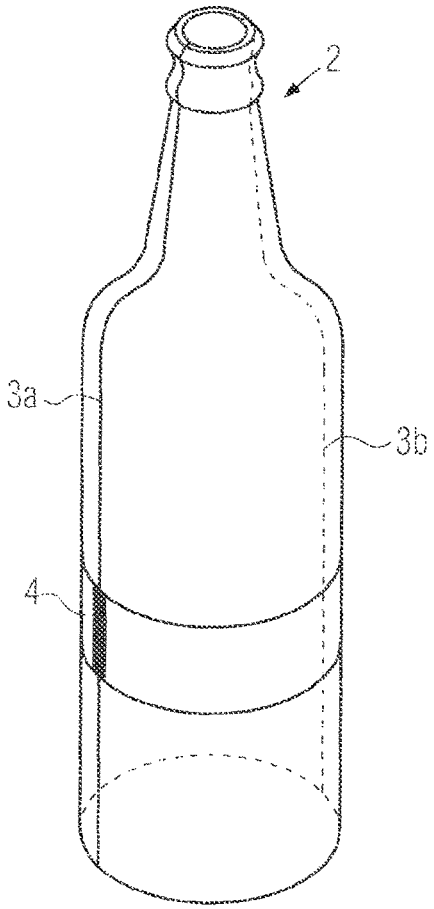

In comparison, FIG. 1*b* shows schematically a print as it is obtained with a direct printing device according to the invention, for example, the device described below in the context of FIG. 2. It is indicated there that print seam 4 coincides or is substantially superimposed with one of the container seams, presently container seam 3*a*.

Figure 2:
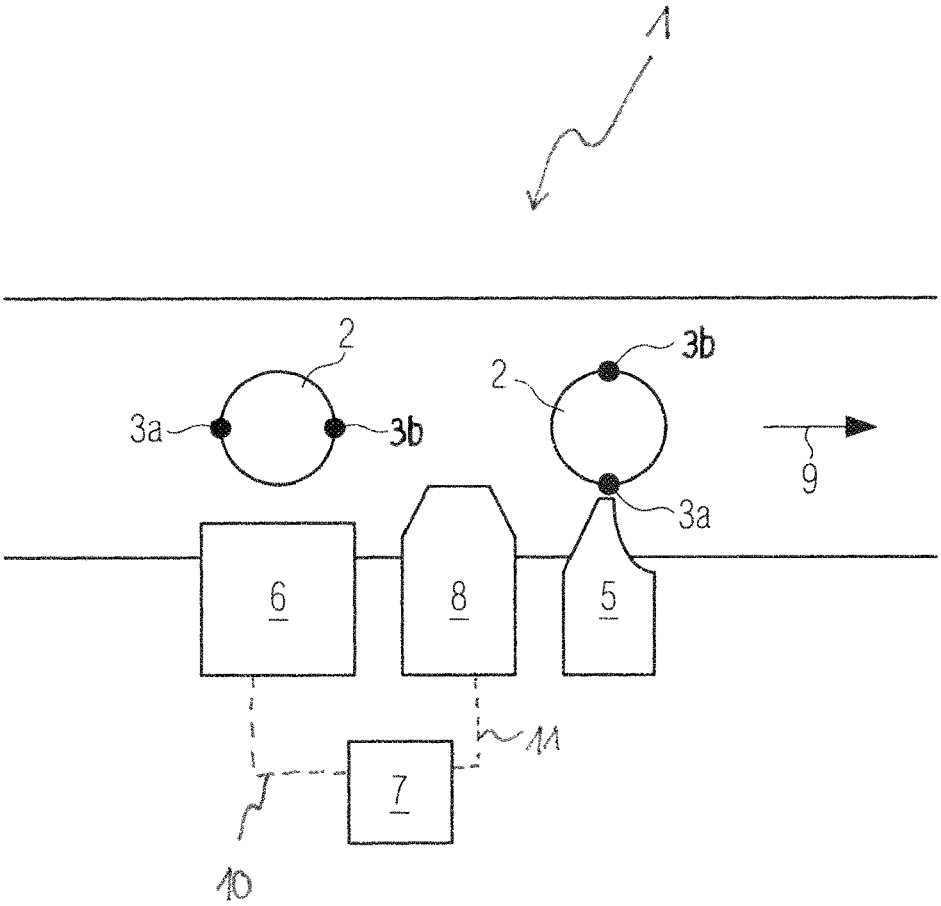
FIG. 2 is a schematic, not-to-scale top view onto a direct printing device.

FIG. 2 is a schematic and not-to-scale representation of a possible embodiment of direct printing device 1 according to the invention.

Shown schematically in the figure are a printhead 5 for direct printing onto containers, a detection device 6, a computing device 7 and an orientation device 8.

Containers 2 are transported on a transport path that is presently formed in a straight line. The containers could be, for example, bottles. They could be transported, for example, suspended by the neck of the bottle. Alternatively, a rotary machine can be employed with which the containers are transported on a circular transport path. Instead of transportation in a suspended manner, transportation in upright standing manner, for example, in a puck, or transportation where the containers stand in a plate and are held from above with a centering device, is also possible.

The detection device, being configured to detect at least one predetermined feature of the container, is arranged along the transport path of the containers in such a way that the containers, in particular features on the containers, can be detected.

For example, a camera can be provided there and image a predetermined section of the transport path.

Features on the containers that can be detected by way of the detection device can be, for example, markings applied to containers in preceding steps. Alternatively or in addition, print seams or other shapes of the container, on the basis of which the orientation of the container can be determined, can also constitute such features.

The direct printing device is presently adapted in such a way that the detection device passes data to the computing device.

The computing device is configured to determine, based on the data received from the detection device, whether and, if so, how the container is to be oriented in order to be moved from an actual container orientation to a predetermined target container orientation.

For this purpose, it is not necessarily required to calculate the actual container orientation. It is instead sufficient that it can be determined in some form, for example, by querying value tables, with which parameters the orientation device is to be operated when the detection device has detected a certain feature at a certain location. It can then still be achieved without an explicit indication of the actual or target container orientation that the container is moved from the actual to the target container orientation.

The orientation device is illustrated in the figure in the direction of transport 9 of the container downstream of the detection device and is configured to orient containers in order to move them from an actual container orientation to a predetermined target container orientation.

The orientation device can be adapted in particular to rotate the containers about their own axis by a predetermined angle. However, a translational motion of the containers is not excluded.

The direct printing device is adapted in such a way that the orientation device receives data from the computing device, in particular such that it moves the containers to the target container orientation based on respective results from the computing device.

The target container orientation is there predetermined such that the container seam is oriented relative to the printhead such that a print seam which is produced during the application of a circumferential print substantially coincides with the container seam.

The detection device can be connected to the computing device via a data connection 10 and the orientation device can be connected to the computing device via a data connection 11. However, it is also conceivable that the computing device is formed integrally with the detection device or the orientation device. The detection device, the computing device, and the orientation device could in particular also be formed integrally.

An example of a method according to the invention is described hereafter which can be carried out, for example, by way of one of the above-described or another direct printing device.

The direct printing system is loaded with containers. The containers are transported along a transport path. The containers first pass a detection device. It detects features of the containers, for example, optically. The containers, provided they are not already in a target orientation, are then oriented by way of an orientation device, for example, rotated about their axis or shifted, such that they are made to assume a target orientation. The containers are then directly printed on circumferentially by way of the printhead. For this purpose, the containers can either be rotated and/or the printhead can be moved around the containers.

The features detected by the detection device are used for determining whether and how the containers are to be oriented. For example, they can be used to determine the actual container orientation. It can then be compared to the target container orientation in order to then determine whether and how the containers are to be oriented. Alternatively, it is possible to determine on the basis of the positions of the features whether and how the container is to be oriented, i.e. without determining the container orientation. For example, certain parameters for the orientation setup can be stored for specific positions of the features.

It is presently to be noted that containers often have two opposite container seams (due to the manufacturing process). In this case, the orientation of the container can then possibly not be determined unambiguously from the position of a container seam. However, since the orientation of the container is ultimately geared toward the suitable orientation of one of the container seams, it is not necessarily relevant how the container itself is oriented, as long as the orientation of one of the container seams is known and can be adjusted.

During the printing process, care can be taken to ensure that the print begins at a suitable location of the print, so that neither the print seam nor the container seams run in the region of the main components of the print.

It is understood that the features mentioned in the embodiments described above are not restricted to these specific combinations and are also possible in any other combination.

The invention claimed is:

1. A direct printing device for applying a circumferential print onto a container with at least one container seam, comprising:

a printhead adapted for printing directly onto said container;

a detection device which is adapted in such a way that at least one predetermined feature of said container is recorded;

a computing device which is configured to determine, based on said at least one feature, whether and, if so, how said container is to be oriented in order to be moved from an actual container orientation to a predetermined target container orientation; and an orientation device configured to orient said container to said target container orientation based on the determination by said computing device, where said target container orientation is predetermined such that the container seam is oriented relative to said printhead such that a print seam, which is created during the application of a circumferential print, substantially coincides with said container seam.

2. The direct printing device according to claim 1, where said orientation device is adapted such that, after orientation of said container, said container seam is arranged at a location where, during operation, the circumferential printing begins and/or ends during operation.

3. The direct printing device according to claim 1, where said computing device is adapted such that it determines an actual position of said at least one feature and such that, based on the actual position of said at least one feature and a predetermined target position of said at least one feature, it determines whether and, if so, how said container is to be oriented.

4. The direct printing device according to claim 3, where said computing device is adapted such that it determines the actual position of said at least one feature and that it determines the actual container orientation based on the actual position of said at least one feature and that it determines, based on said actual container orientation and said target container orientation, whether and, if so, how said container is to be oriented.

5. The direct printing device according to claim 3, where said detection device is adapted such that said at least one feature is detected optically, and where said computing device is adapted such that one or the actual position of said at least one feature is determined by way of image recognition.

6. The direct printing device according to claim 1, where said detection device comprises a camera which images at least one partial region of said container, where said at least one partial region is selected in such a way as to ensure that said at least one feature is located in said at least one partial region, regardless of the actual container orientation.

7. The direct printing device according to claim 1, where said orientation device is configured to rotate said container about its own axis.

8. The direct printing device according to claim 7, where said orientation device is adapted in such a way that an angle by which said container is rotated during the orientation depends at least on the actual container orientation and the predetermined target container orientation.

9. A direct printing device according to claim 1, wherein the at least one container seam is a press seam that runs along the longitudinal axis of the container and/or the print seam is located at an overlap or connection region where the circumferential print begins and ends.

10. A direct printing method for applying a circumferential print onto a container with at least one container seam, comprising:

recording at least one predetermined feature of said container by way of a detection device;

determining by way of a computing device, based on said at least one feature, whether and, if so, how said container is to be oriented in order to be moved from an actual container orientation to a predetermined target container orientation;

orienting said container to said target container orientation based on the determination by said computing device; and printing on said container by way of a printhead after said container has been oriented, where said target container orientation is predetermined such that said container seam is oriented relative to said printhead such that a print seam, which is created during application of a circumferential print, substantially coincides with said container seam.

11. The direct printing method according to claim 10, where, after said container has been oriented, said container seam is arranged at a location where the circumferential print begins and/or ends.

12. The direct printing method according to claim 11, where the actual position of said at least one feature is determined, the actual container orientation is determined based on the actual position of said at least one feature, and it is determined based on the actual container orientation and the target container orientation whether and, if so, how said container is to be oriented.

13. The direct printing method according to claim 11, where said at least one feature is detected optically the actual position of said at least one feature is determined by means of image recognition.

14. The direct printing method according to claim 10, where an actual position of said at least one feature is determined and, based on the actual position of said at least one feature and a predetermined target position of said at least one feature, it is determined whether and, if so, how said container is to be oriented.

15. The direct printing method according to claim 10, where at least one partial region of said container is imaged, where said at least one partial region is selected in such a way as to ensure that said at least one feature is located in said at least one partial region, regardless of the actual container orientation.

16. The direct printing method according to claim 10, where said container is rotated about its own axis for orienting said container about an angle that depends at least on the actual container orientation and the predetermined target container orientation.

17. A direct printing method according to claim 10, wherein the at least one container seam is a press seam that runs along the longitudinal axis of the container and/or the print seam is located at an overlap or connection region where the circumferential print begins and ends.

* * * * *